US005566393A

United States Patent [19]

Best

[11] Patent Number: 5,566,393

[45] Date of Patent: Oct. 22, 1996

[54] SLITTED REVERSIBLE CHEERLEADING SKIRT

[75] Inventor: Emory R. Best, Dallas, Tex.

[73] Assignee: National Spirit Group, Ltd., Dallas, Tex.

[21] Appl. No.: 501,442

[22] Filed: Jul. 12, 1995

[51] Int. Cl.[6] ..... A41D 1/14

[52] U.S. Cl. ..... 2/74; 2/211; 2/DIG. 2

[58] Field of Search ..... 2/74, 75, 67, 105, 2/211–213, 226, 272, 48, DIG. 2, DIG. 4, 243.1; D2/735, 736, 740, 741, 775, 776, 851, 852, 861

[56] References Cited

U.S. PATENT DOCUMENTS

| | | | |
|---|---|---|---|
| D. 138,128 | 6/1944 | Nachman et al. | 2/226 X |
| 988,350 | 4/1911 | Kelsey | 2/211 |
| 1,076,124 | 10/1913 | Juda | 2/Dig. 2 X |
| 1,104,185 | 7/1914 | George | 2/211 |
| 2,570,848 | 10/1951 | Ozenberger | 2/48 |
| 2,791,779 | 5/1957 | Presson | 2/DIG. 2 X |
| 5,327,586 | 7/1994 | Evans etal. | 2/211 |

OTHER PUBLICATIONS

Catalog Advertisement for "Breakaway™ Skirt"and "Fly–a-way Skirt", pp. 67–68; *Cheerleading & Danzteam Catalog*, 1995.

Catalog Advertisement for "Fly–away Skirt", p. 82; *Cheerleader & Danzteam Catalog*, 1994.

Catalog Advertisement for "Fly–away Skirt", p. 90; *Cheerleader/Team Mates Catalog*, 1993.

*Fashions of the Decade: The 1960's;* 1990; p. 63.

*Primary Examiner*—C. D. Crowder
*Assistant Examiner*—Gloria Hale
*Attorney, Agent, or Firm*—Richards, Medlock & Andrews

[57] ABSTRACT

A reversible skirt suitable for cheerleading is disclosed which provides for active movement of the wearer, and desirable movement and visual effects of the skirt during wearing. Preferably, the skirt is constructed of 8–20 panels which are each sewn only partially along their length to adjoining panels. Alternatively, a skirt can be made from at least one panel into which slits are cut to form a visual effect of pleats. Different colors can be used for each side of the skirt and the alternate color is partially visible when either skirt is worn for increased visual variety.

14 Claims, 3 Drawing Sheets

SLITTED REVERSIBLE CHEERLEADING SKIRT

TECHNICAL FIELD OF THE INVENTION

This invention relates to the field of wearing apparel and more particularly to apparel for cheerleaders.

BACKGROUND OF THE INVENTION

Cheerleading has been a popular pursuit among students in grade schools, middle schools, high schools, and colleges for many years. In recent years, professional cheerleaders have been performing at football, basketball and other professional sporting events. Traditionally, cheerleaders have worn shortened versions of street clothing made in school or team colors. Female cheerleader uniforms, especially at the school level, often include a pleated skirt which is a shortened version of a classic pleated skirt such as might be found in collections of street clothing for women and girls. Such skirts are made of a layer of material, one side meant to be exposed and one side meant to be concealed next to the wearers' body. The concealed side contains the raw edges and seams which are generally unattractive in appearance.

The modern cheerleader is most often an athlete, a dancer, and a gymnast required to perform complex choreographed routines. The gymnastics and tumbling movements as well as the funk, jazz and other dance steps used by the cheerleader have led to requirements for apparel which will permit the desired movements. In addition, it is sometimes desirable to have the apparel of the cheerleader enhance the visual effect of the movements.

As a further consideration, there is also a need for school-aged cheerleaders in particular to maximize the investment made in cheerleading apparel. Cheerleaders often have to pay for their own uniforms and, since schools typically use one color for "home" games and the other for "away" games, multiple uniforms may be required which are identical except for the color.

Despite the introduction of shorts, leggings and other alternative types of clothing into the cheerleader's costume choices to permit the enhanced movements and visual effects, there is also a desire to maintain the traditional, classic look of the cheerleader wearing a pleated, short skirt for certain routines or portions of routines. Since, as stated above, the concealed side of the traditional pleated skirt is unattractive, it is undesirable for a cheerleader wearing such a skirt to employ moves in her routine which would tend to cause the skirt to fly up or flip outward. Further, the construction of such skirts may make such moves as splits and kicks restricted or impossible to include in the routine.

A new skirt is herein disclosed which solves the problems discussed above. The skirt is fully reversible so that there are no unfinished seams and edges to be exposed during the routines. The skirt is constructed with a plurality of panels which are connected to adjoining panels only a partial distance from the top of the skirt, thus providing for increased mobility of the wearer in cheerleading routines. One side of the skirt is preferably made in an alternate color so that the cheerleader, by purchase of only one garment, has a uniform skirt in two different team colors.

The design of the skirt also contributes to the visual effects of the cheerleader routine. In the embodiment where an alternative color is employed on one side, the audience is able to view both team colors during the routine as movements are employed by the wearer. Movements can also be employed by the wearer which cause the individual panels to move in attractive patterns. The skirt, while providing for unique visual effects, also presents the appearance of the classic pleated cheerleading skirt while the wearer is in a rest standing position.

SUMMARY OF THE INVENTION

In accordance with the present invention, a reversible cheerleading skirt is disclosed which comprises a waistband, and a plurality of panels extending downwardly from the waistband. The panels are attached to adjacent panels for only part of their length. The sections of the panels which are nonattached result in non-overlapping flaps. A minimum of eight panels are employed.

In a preferred embodiment, the skirt is constructed with one color on one side and a contrasting color on the other side. Preferably, the closing means includes a reversible zipper placed between two of the panels, and a button and button hole on the waistband. A button is preferably placed on both sides of the waistband to allow for full reversibility.

In another embodiment, a reversible cheerleading skirt is constructed from at least one panel in which slits are cut from the hem edge partially up the panel, forming individual panels. A like panel is constructed and the two panels are attached to form a reversible skirt composite which is then joined to a waistband.

In another embodiment, the waistband is elasticized so that no closure device is required to be inserted between panel to panel seams.

DETAILED DESCRIPTION

Figure 2:
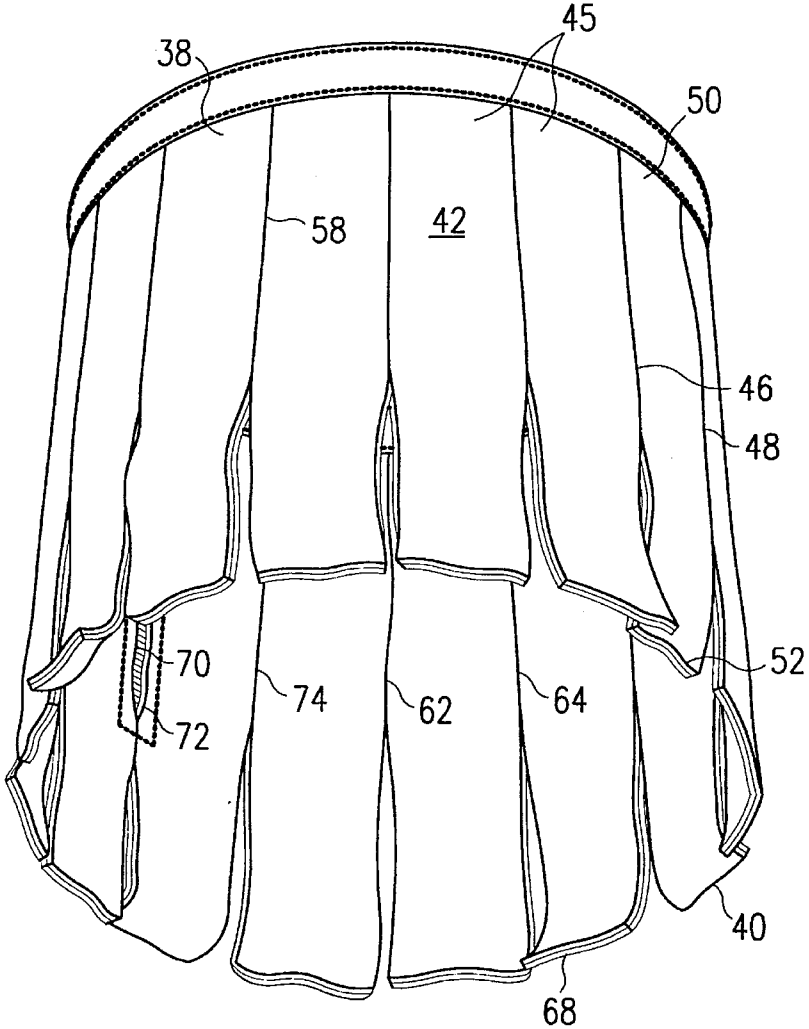
FIG. 2 shows a perspective view of the skirt of FIG. 1 from the hem area, showing partial views of both sides of the skirt.

The present invention comprises a reversible skirt suitable for cheerleading. The skirt is preferably constructed of sturdy, washable material suitable for use in outdoor sporting settings, however any material which can be constructed into the desired shape may be used. Preferably, a polyester, wool, or blend thereof is employed. Most preferably, two different colors of material are used so that when the skirt is reversed, the wearer has an alternative look.

A preferred method of securing or attaching the parts of the skirt together is by sewing or stitching. Other methods can be used such as application of adhesives, but this is less preferred.

Panels of a suitable size and width can be made by measuring the wearer or by using standard measurements in the art for misses, juniors or children's sizes. The width of the panels is preferably from about 2" to about 8" (finished) at the hem, most preferably about 3¼" to about 5". The unfinished panels prior to joining are from about 2.4" to about 8.4" and preferably about 3.9" to about 5.4". The width of the panels at the waist is preferably from about 1" to 3.5" (finished), 1½" to 4" (unfinished) and most preferably 1½" to 1¼" (finished) and 2" to 2.75"(unfinished). It is desirable that the panel flare out and thus be made wider at the hem edge. The number of panels needed will depend on the size of the proposed wearer, the desired visual effect of the skirt in motion, and the desired width of the panels.

At least 8 skirt panels are attached to adjacent skirt panels partially along two long edges of the panel. The portion of the panels unattached to adjacent panels is attached to the panels comprising the reversible skirt. Preferably, 10–20 panels are utilized and most preferably, 16 panels. The number of panels used can be altered to alter the visual effect and movement of the skirt. A composite skirt assembly is formed from the attached 10 panels of one side of the reversible skirt after attachment to the attached panels of the other side of the reversible skirt. A closure device is preferably inserted between the long edges of two panels, designated herein as closure long edges. The closure device is preferably a reversible zipper, but other closures such as buttons, hook and loop fasteners, snaps and other closures common in the clothing art may be used with minor modifications such as are well known in the art. In an alternate embodiment, the closure long edges are attached, to other long edges in the same way as the other long edges are attached to each other, and an elastic waistband is employed which permits the wearer to utilize the garment by stretching the waistband over the hips and allowing it to retract on the waistline of the wearer.

In another embodiment, a first construct is made from at least one panel having first short edge and a second short edge, a third hem edge and a fourth waist edge is constructed into a skirt and individual panels are fashioned by cutting slits from the third hem edge partially up toward the fourth edge. A like second construct is made from at least one other panel, and the first and second construct attached, wrong sides together. The first and second constructs together form a composite skirt assembly. The panel hem edge is longer than the waist edge and the exact dimensions may be determined by the size of the wearer's waist as well as the desired flare out of the hem from the waist.

A waistband assembly is made from at least two substantially rectangular strips attached together. The wrong side of each strip are adjacent in the final assembly. The waistband assembly may be the same length as or longer than the top of the composite skirt assembly. In a preferred embodiment, the waistband assembly is longer than the top of the composite skirt assembly, forming a flap portion unattached to the top of the composite skirt assembly. The flap portion is desirable because it allows for a neat, tailored appearance which will not become easily unsecured during movement. For example, a button can be positioned near the area where the skirt is attached to the waistband. Another button can be positioned on the other side of the waistband assembly. A buttonhole can be placed on the other end of the waistband which serves either side of the reversible skirt. The flap attractively tucks under the opposite end when the skirt is buttoned, no matter which side of the reversible skirt is being utilized, providing a tailored finished appearance and making it more difficult for the button to come out of the buttonhole. The material of the waistband can match or contrast with the skirt.

Figure 1:
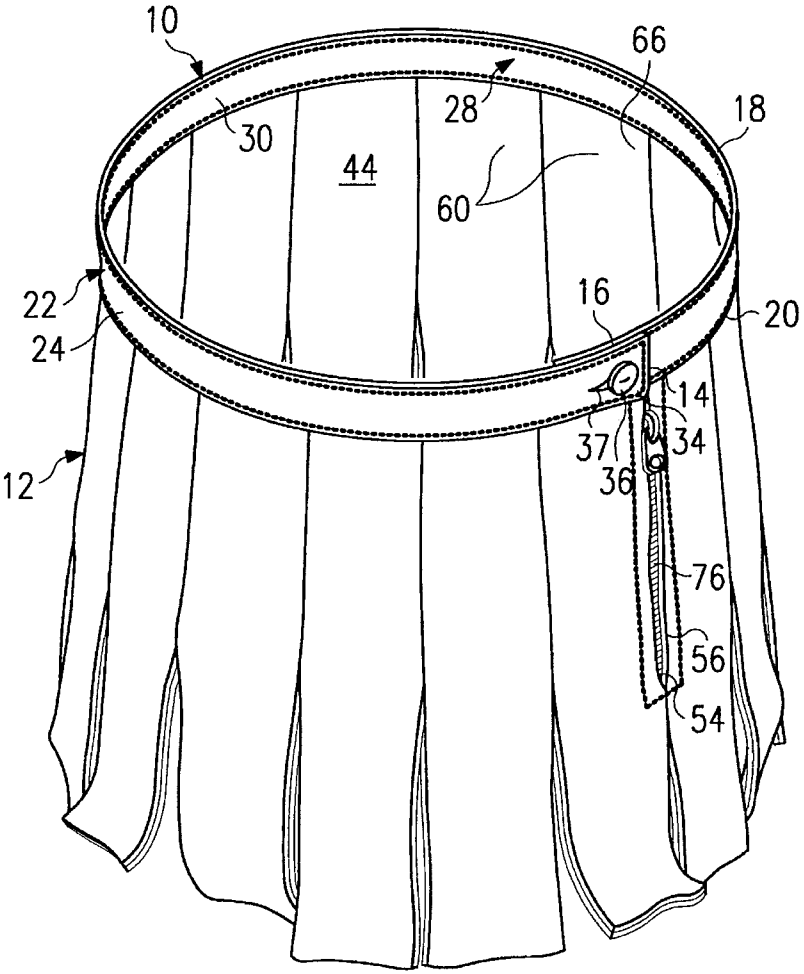
FIG. 1 shows a perspective view of an embodiment of the skirt invention constructed from sixteen panels on one side and sixteen on the other with a zipper closure depicting the inside and outside of the skirt.

Referring in detail to the drawings, a preferred form of cheerleading skirt is illustrated in FIGS. 1 and 2. To this end, the skirt is broadly comprised of a waistband assembly 10 and a composite skirt assembly 12. The waistband has two ends 14 and 16, a top edge 18, and a bottom edge 20. The waistband assembly is made up of a first waistband component 22 having a right side 24 and an opposite side (not visible), and a second waistband component 28 having a right side 30 and an opposite side (not visible). The two waistband components 22 and 28 are attached so that their opposite sides are adjacent. The waistband assembly 10 is shown longer than the top edge of the composite skirt assembly 12 forming a flap portion 34 which is unattached to the composite skirt assembly 12. A button 36 is shown secured to waistband right side 24 and another button (not shown) can be attached to right side 30 at the same relative position. Buttonhole 37 is illustrated which can attach to either button 36 or the button attached to 30 as described when the skirt is reversed.

The composite skirt assembly has a top edge 38 and a hem edge 40. The top edge 38 is attached to the bottom edge 20 of the waistband. The composite skirt assembly is formed by a first skirt assembly 42 and a second skirt assembly 44.

As best seen in FIG. 2, the first skirt assembly 42 is made up of a plurality of first skirt panels 45 illustrated, in FIG. 2 as 16 panels. Each of the skirt panels has a first 46 and second 48 long edge, a top edge 50, and a hem edge 52. The long edges of the panels 46 and 48 are attached to the long edges of adjacent panels. One of the skirt panels has a closure first long edge 54, and a second skirt panel has a closure second long edge 56. Skirt panels are connected along their first and second long edges 46 and 48 to adjacent panels to form an attachment seam 58 which extends partially down the long edges, preferably about one third to one half the length of the long edges.

The second skirt assembly 44 is made up of a plurality of second skirt panels 60. Each of the skirt panels has a first 62 and second 64 long edge, a top edge 66, and a hem edge 68. The long edges of the panels 62 and 64 are attached to the long edges of adjacent panels. One of the skirt panels has a closure first long edge 70, and a second skirt panel has a closure second long edge 72. Skirt panels are connected along their first and second long edges 62 and 64 to adjacent panels to form an attachment seam 74 which extends partially down the long edges, preferably about one third to one half the length of the long edges.

The first skirt assembly 42 is attached to the second skirt assembly 44 by attachment of the long edges 46 and 48 of the first skirt panels to the long edges 62 and 64 of the second skirt panels in the area below the attachment seam 58 and 74 and along the respective hem edges 52 and 68.

A closure apparatus of a reversible zipper 76 is illustrated as attached to the closure first 54 and second 56 long edge of the first skirt assembly 42, and the closure first 70 and second 72 long edge of the second skirt assembly 44.

Figure 4:
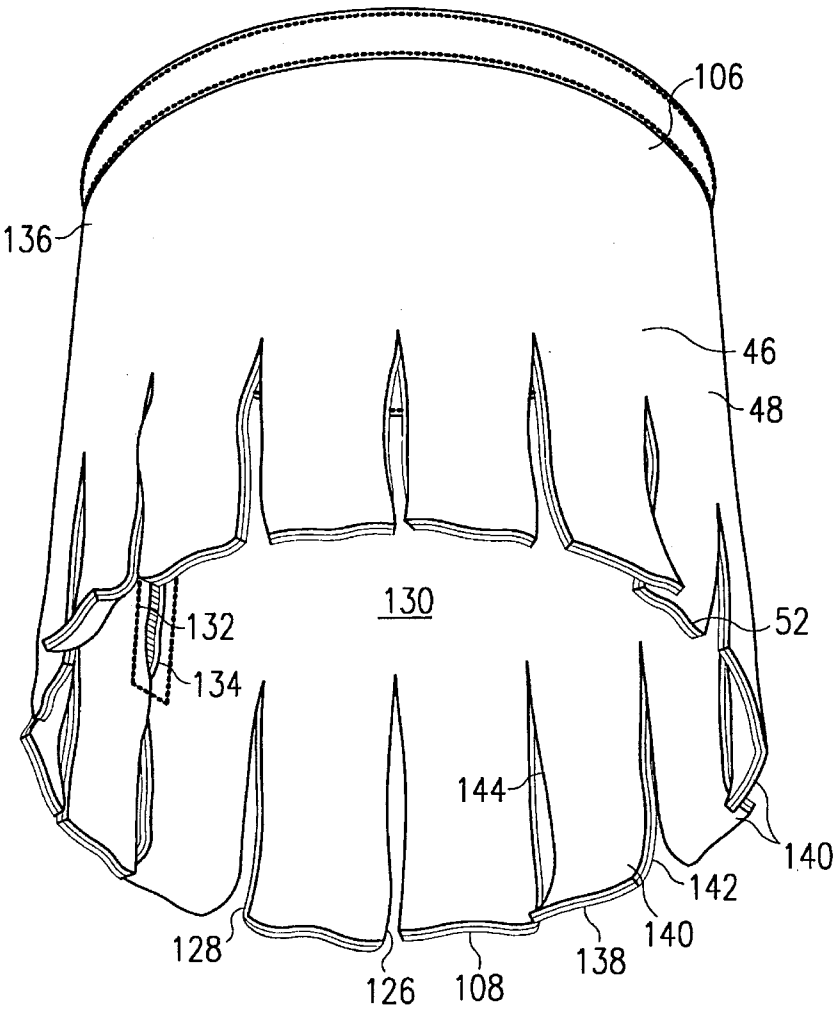
FIG. 4 shows a perspective view of the skirt of FIG. 3 looking upward from the hem region.
Figure 3:
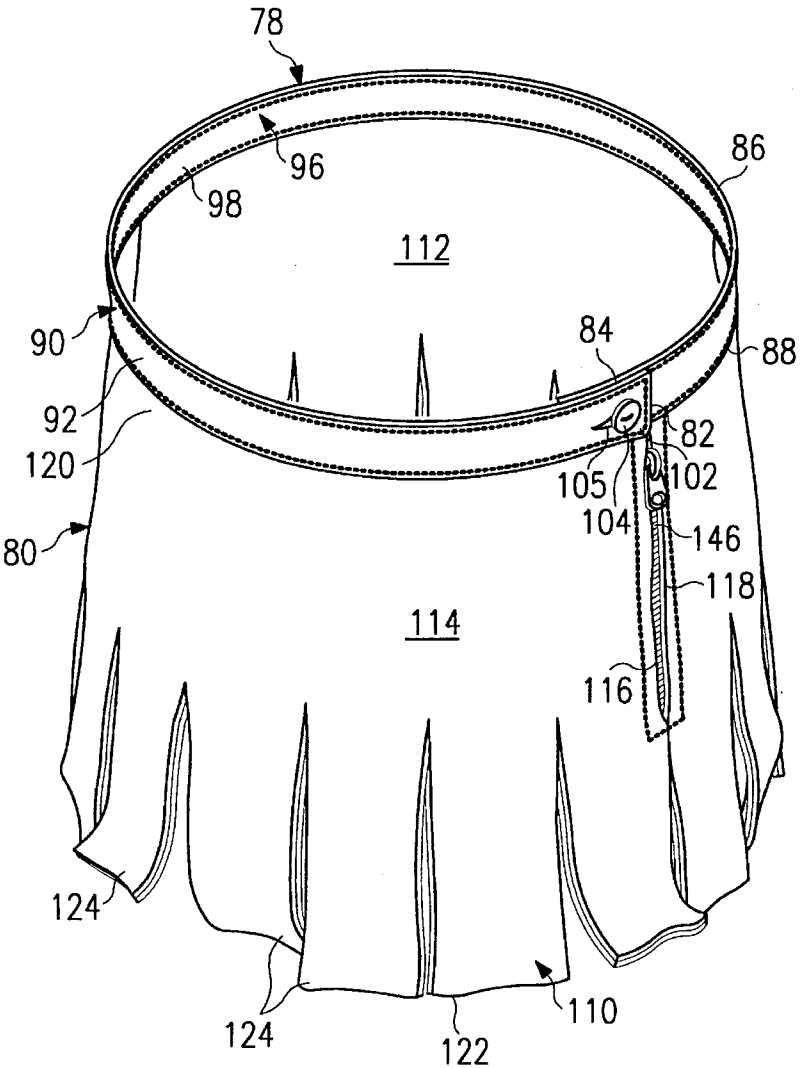
FIG. 3 shows a perspective view of an alternative embodiment made from two panels forming one side and two forming the other, each slit along the hem and the sides sewn together.

Another embodiment of the cheerleading skirt is illustrated in FIGS. 3 and 4. To this end, the skirt is broadly comprised of a waistband assembly 78 and a composite skirt assembly 80. The waistband has two ends 82 and 84, a top edge 86, and a bottom edge 88. The waistband assembly 78 is made up of a first waistband component 90 having a right side 92 and an opposite side (not visible), and a second waistband component 96 having a right side 98 and an opposite side (not visible). The two waistband components 90 and 96 are attached so that their opposite sides are adjacent. The waistband assembly can be longer than the top edge 86 of the composite skirt assembly 80 forming a flap portion 102 which is unattached to the composite skirt assembly 80. A closure device of a button 104, is attached to each side of one end of the waistband assembly. The closure device is capable of attaching to a second closure device in the form of a button hole 105.

The composite skirt assembly 80 has a top edge 106 and a hem edge 108. The top edge 106 is attached to the bottom edge 88 of the waistband. The skirt assembly 80 is formed by a first skirt assembly 110 and a second skirt assembly 112.

The first skirt assembly 110 is made up of one skirt panel 114. The panel has a first 116 and second 118 closure long edge, a top edge 120, and a hem edge 122. The panel has been cut along regular intervals from the hem edge 122 towards the top edge 120 creating a series of non-overlapping flaps 124 which have a right edge 126 and a left edge 128.

The second skirt assembly 112 is made up of one skirt panel 130. The panel has a first 132 and second 134 closure long edge, a top edge 136, and a hem edge 138. The panel has been cut along regular intervals from the hem edge 138 towards the top edge 136 creating a series of non-overlapping flaps 140 which have a right edge 142 and a left edge 144.

The first skirt assembly 110 is attached to the second skirt assembly 112 by attachment of the left and right sides of the flaps 126 and 128 of the first skirt assembly 110 to the left and right edges of the flaps 144 and 142 of the second skirt assembly 112. The raw edges may be hidden turning the seams inside or an appropriate finishing stitch may be used to obviate the need to turn. Also, the hem edge 122 of the first skirt assembly 110 is attached to the hem edge 138 of the second skirt assembly 112.

A closure apparatus of a reversible zipper 146 is shown connected to the first and second closure long edge 116 and 118 of the first skirt assembly 110, and the first and second closure long edge 132 and 134 of the second skirt assembly.

Figure 5:
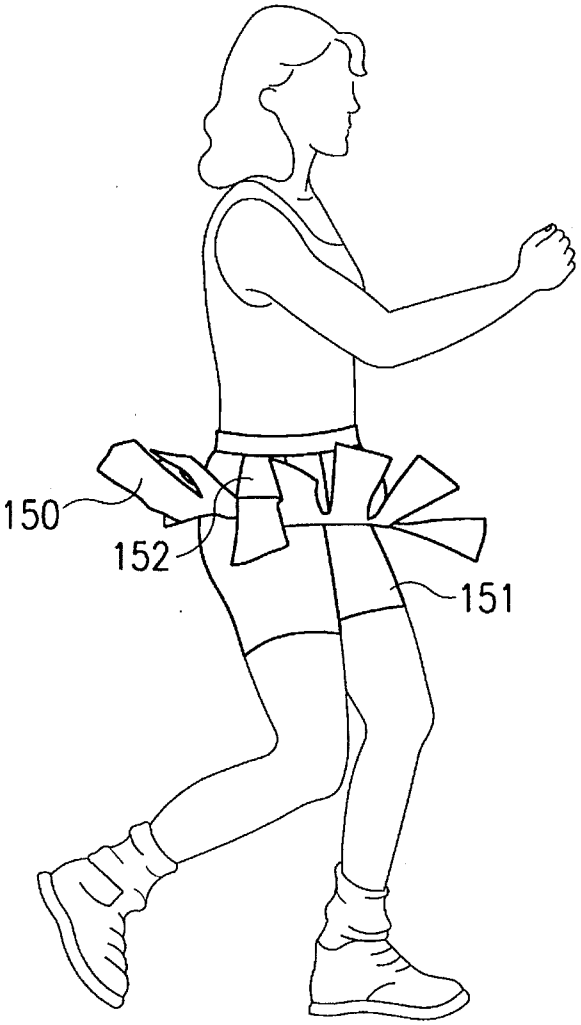
FIG. 5 shows an embodiment of the skirt invention on a wearer in motion.

FIG. 5 shows an embodiment of the skirt on a wearer. In response to certain movements of the wearer, the reverse side 150 of the skirt is exposed. The wearer is shown wearing pants 151, which are not a part of the skirt but a separate garment. During exposure of the skirt's reverse side 150, the outer side of the skirt 152 is also visible. In a preferred embodiment of FIG. 5, the reverse side 150 of the skirt is in a contrasting color to the outer side of the skirt 152, providing for visual diversity during the routine.

Figure 6:
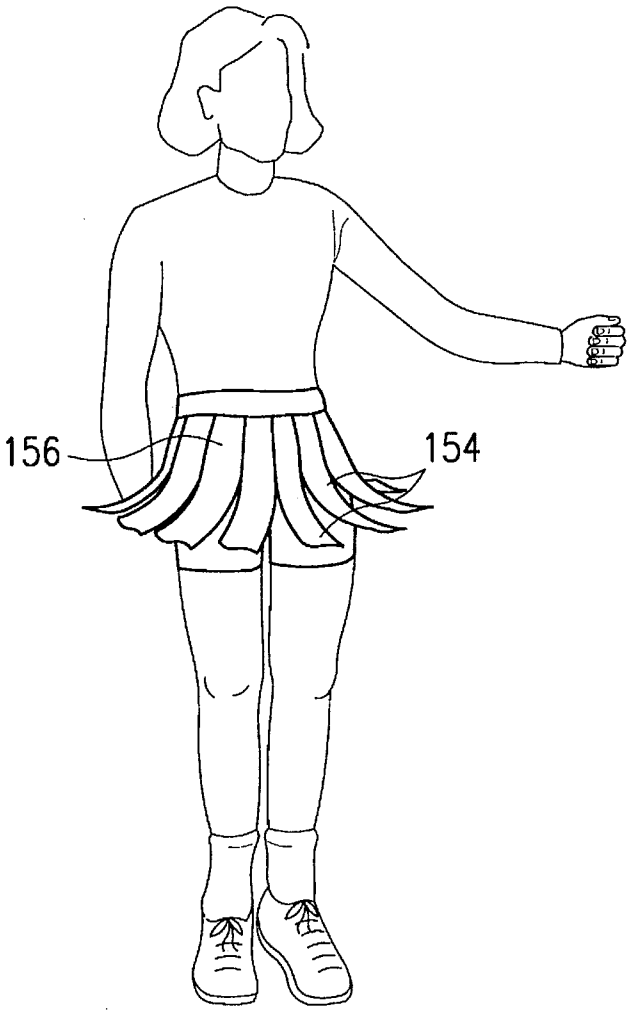
FIG. 6 shows an embodiment of the skirt invention on a wearer in the process of completing motion which has resulted in the depicted movement of the skirt.

FIG. 6 shows an embodiment of the skirt on a wearer in action. In response to certain movements such as a "basketball toss", during which the wearer is tossed straight up in the air and is then caught, the skirt flaps 154 break away from one another to create the unique effect illustrated. The outer side of the skirt 156 remains visible while the underside of the skirt (not visible) may be exposed. In a preferred embodiment of FIG. 6, the outer side and underside of the skirt are of contrasting colors.

I claim:

1. A reversible skirt suitable for cheerleading and other active sports, comprising:

a waistband assembly having two ends, a top edge and a bottom edge, said waistband assembly comprising a first waistband component having a right side and an opposite side, and a second waistband component having a right side and an opposite side, said first and second waistband components attached to each other so that the respective opposite sides are adjacent;

a composite skirt assembly having a top edge and a hem edge, said top edge of said composite skirt assembly attached to said waistband assembly, said composite skirt assembly comprising a first skirt assembly and a second skirt assembly;

said first skirt assembly comprising at least eight first skirt panels, each of said first skirt panels having a first long edge and a second long edge, a first top edge and a second hem edge; one of said first long edges designated a closure first long edge and one of said second long edges designated a closure second long edge; each of said first long edges, except said closure first long edge, attached to one of said second long edges, except said closure second long edge, of another of said first skirt panels along an attachment seam, said attachment seam extending only partially along the length of said respective long edges;

said second skirt assembly comprising at least eight second skirt panels, each of said second skirt panels having a first long edge and a second long edge, a first top edge and a second hem edge; one of said first long edges designated a closure first long edge and one of said second long edges designated a closure second long edge; each of said first long edges, except said closure first long edge, attached to one of said second long edges, except said closure second long edge, of another of said second skirt panels along an attachment seam, said attachment seam extending only partially along the length of said respective long edges;

said first skirt assembly attached to said second skirt assembly by attachment of said first and second long edges of said first skirt panel to said first and second long edges of said second skirt panels below said attachment seam and along said respective hem edges; and a closure apparatus connected to said closure first long edge of said first skirt assembly, said closure second long edge of said first skirt assembly, said closure first long edge of said second skirt assembly and said closure second long edge of said second skirt assembly.

2. The skirt of claim 1, wherein said first skirt assembly comprises sixteen first skirt panels and said second skirt assembly comprises sixteen second skirt panels.

3. The skirt of claim 1, wherein said first skirt assembly comprises fourteen first skirt panels and said second skirt assembly comprises fourteen second skirt panels.

4. The skirt of claim 1, wherein said first skirt assembly comprises twelve first skirt panels and said second skirt assembly comprises twelve second skirt panels.

5. The skirt of claim 1, wherein said first skirt assembly comprises ten first skirt panels and said second skirt assembly comprises ten second skirt panels.

6. The skirt of claim 1, wherein said first skirt assembly comprises eight first skirt panels and said second skirt assembly comprises eight second skirt panels.

7. The skirt according to claim 1, wherein said waistband assembly is longer than said top edge of said composite skirt assembly, forming a flap portion which is unattached to said composite skirt assembly along its bottom edge.

8. The skirt of claim 7, wherein first waistband closure devices are attached to each side of one end of said waistband assembly along said portion, said first waistband closure devices capable of attaching to a second waistband closure device located on said other end of said waistband assembly.

9. The skirt of claim 8, wherein said first waistband closure devices are buttons and said second waistband closure device is a button hole.

10. The skirt of claim 8, wherein said first waistband closure devices are hook and loop fasteners and said second waistband closure device is a complementary hook and loop fastener.

11. The skirt of claim 1, wherein said closure apparatus is a zipper.

12. A reversible skirt suitable for cheerleading and other active sports, comprising:

a waistband assembly having two ends, a top edge and a bottom edge, said waistband assembly comprising a first waistband component having a right side and an opposite side, and a second waistband component having a right side and an opposite side, said first and second waistband components attached to each other so that the respective opposite sides are adjacent;

a composite skirt assembly having a top edge and a hem edge, said top edge of said composite skirt assembly attached to said waistband assembly, said composite skin assembly comprising a first skin assembly and a second skirt assembly;

said first skirt assembly comprising sixteen first skirt panels, each of said first skirt panels having a first long edge and a second long edge, a first top edge and a second hem edge; each of said first long edges, except a closure first long edge, attached to one of said second long edges, except a closure second long edge, of another of said first skirt panels along an attachment seam, said attachment seam extending from about one third to about one half the length of said long edges;

said second skirt assembly comprising sixteen second skirt panels, each of said second skirt panels having a first long edge and a second long edge, a first top edge and a second hem edge; each of said first long edges, except a closure first long edge, attached to one of said second long edges, except a closure second long edge, of another of said second skirt panels along an attachment seam, said attachment seam extending from about one third to about one half the length of said long edges;

said first skirt assembly attached to said second skirt assembly by attachment of said first and second long edges of said first skirt panel to said first and second long edges of said second skirt panels below said attachment seam and along said respective hem edges; and a zipper attached to said closure first long edge of said first skirt assembly, said closure second long edge of said first skirt assembly, said closure first long edge of said second skirt assembly and said closure second long edge of said second skirt assembly, said zipper having a tab for grasping on both sides and a sliding device for opening and closing said zipper attached to each of said tabs.

13. A reversible skirt suitable for cheerleading and other active sports, comprising:

a waistband assembly having two ends, a top edge and a bottom edge, said waistband assembly comprising a first waistband component having a right side and an opposite side, and a second waistband component having a right side and an opposite side, said first and second waistband components attached to each other so that the respective opposite sides are adjacent;

a composite skirt assembly having a top edge and a hem edge, said top edge of said composite skirt assembly attached to said waistband assembly, said composite skirt assembly comprising a first skirt assembly and a second skirt assembly;

said first skirt assembly comprising at least one panel, said panel divided into non-overlapping flaps extending from the hem edge partially toward the top edge;

said second skirt assembly comprising at least one panel, said panel divided into non-overlapping flaps extending from the hem edge partially toward the top edge;

said first skirt assembly attached to said second skirt assembly to form said composite skirt assembly.

14. A reversible skirt suitable for cheerleading and other active sports, comprising:

an elasticized waistband;

a composite skirt assembly having a top edge and a hem edge, said top edge of said composite skirt assembly attached to said elasticized waistband, said composite skirt assembly comprising a first skirt assembly and a second skirt assembly;

said first skirt assembly comprising at least eight first skirt panels, each of said first skirt panels having a first long edge and a second long edge, a first top edge and a second hem edge; each of said first long edges attached to one of said second long edges of another of said first skirt panels along an attachment seam, said attachment seam extending from about one third to about one half the length of said long edges;

said second skirt assembly comprising at least eight second skirt panels, each of said second skirt panels having a first long edge and a second long edge, a first top edge and a second hem edge; each of said first long edges attached to one of said second long edges, of another of said second skirt panels along an attachment seam, said attachment seam extending from about one third to about one half the length of said long edges;

said first skirt assembly attached to said second skirt assembly by attachment of said first and second long edges of said first skirt panel to said first and second long edges of said second skirt panels below said attachment seam and along said respective hem edges.

* * * * *